US008695652B1

(12) United States Patent
Pattullo

(10) Patent No.: US 8,695,652 B1
(45) Date of Patent: Apr. 15, 2014

(54) TABLE SAW MILL ATTACHMENT

(76) Inventor: George M. Pattullo, Caro, MI (US)

( * ) Notice: Subject to any disclaimer, the term of this patent is extended or adjusted under 35 U.S.C. 154(b) by 407 days.

(21) Appl. No.: 13/111,948

(22) Filed: May 19, 2011

Related U.S. Application Data

(60) Provisional application No. 61/346,033, filed on May 19, 2010.

(51) Int. Cl.
*B27B 1/00* (2006.01)

(52) U.S. Cl.
USPC ..... 144/278.1; 269/131

(58) Field of Classification Search
USPC ..... 144/306, 307, 376, 378, 379, 353, 144/278.1, 278.2, 288.5, 250.25, 48, 48.7, 144/117.1, 118, 129, 171, 48.3; 269/131; 82/46, 47, 101
See application file for complete search history.

(56) References Cited

U.S. PATENT DOCUMENTS 5,109,899 A * 5/1992 Henderickson ..... 144/378
5,135,037 A * 8/1992 Wijesinghe ..... 144/357
6,325,119 B1 * 12/2001 Wolf et al. ..... 144/378

* cited by examiner

*Primary Examiner* — Shelley Self
*Assistant Examiner* — Matthew G Katcoff
(74) *Attorney, Agent, or Firm* — Robert L. Farris; Farris Law, P.C.

(57) ABSTRACT

The table saw mill trolley rolls on rails. A log holder is pivotally attached to the trolley for pivotal movement about first and second axes. A support is fixed to the holder. A log tensioner and log indexer are attached to the support. Centering pins on the tensioner and indexer engage log ends. The trolley supports a log with an indexing shaft axis transverse to the blade axis. A first slot is cut in the log. The log is pivoted about the first axis and the trolley is returned to the start. The log is rotated about the second axis and then pivoted about the first axis to support by the trolley. A second slot that intersects the first slot is cut forming a first log flat surface.

7 Claims, 13 Drawing Sheets

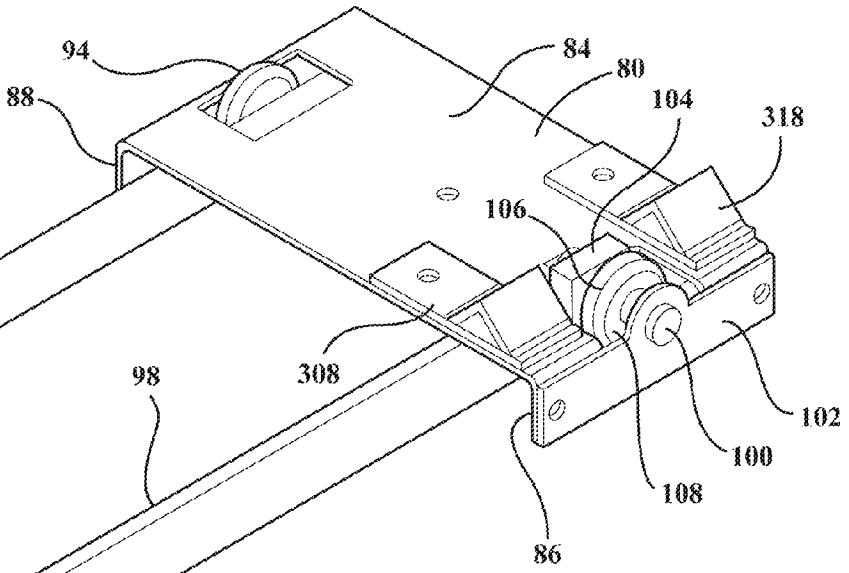
FIG. 12
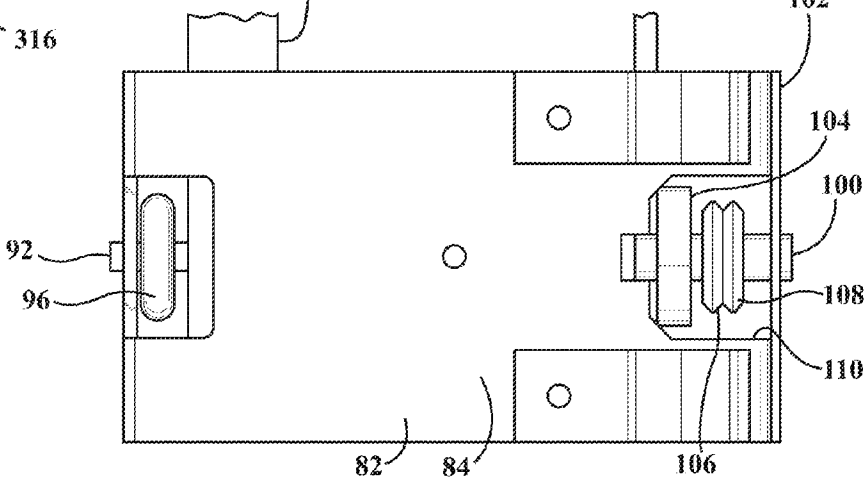
FIG. 13
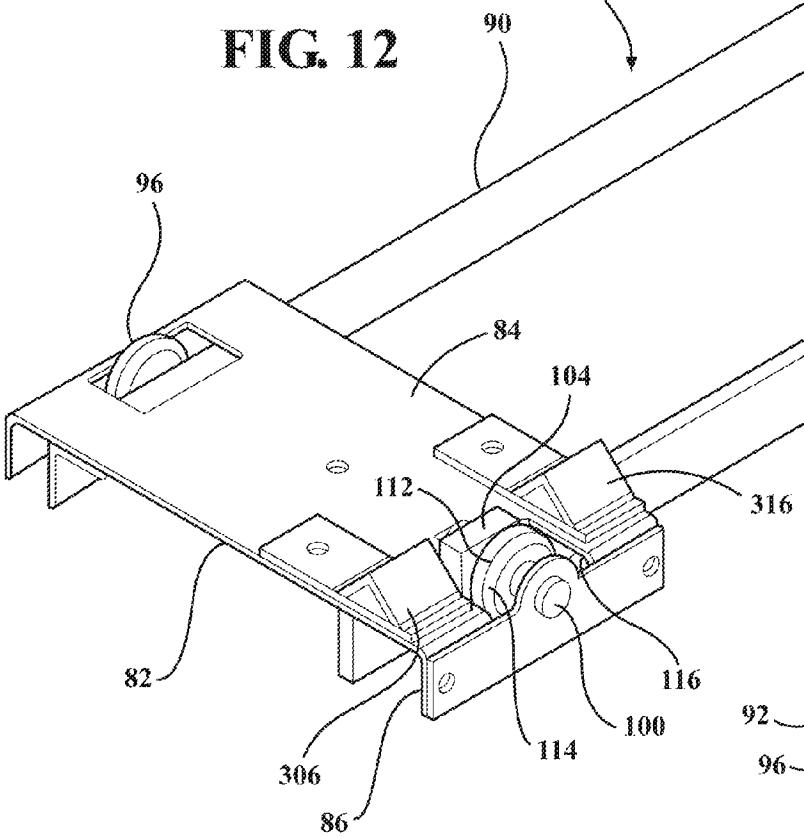

TABLE SAW MILL ATTACHMENT

CROSS REFERENCE TO RELATED APPLICATION

This application claims the benefit of the filing date of U.S. Provisional Application No. 61/346,033, titled TABLE SAW MILL ATTACHMENT filed May 19, 2010.

TECHNICAL FIELD

The table saw mill attachment is mounted on a table saw, holds a log, guides the log parallel to the saw blade to make a first cut and switches the log from end to end, guides the log to make a second cut and forms a log with a generally flat surface and indexes the log and repeats the process to form another flat surface.

BACKGROUND OF THE INVENTION

Large commercial sawmills generally receive logs that are several feet in diameter and over eight feet long. Other commercial sawmills receive logs that are smaller in diameter. A Log with a diameter of less than nine inches are generally discarded by commercial sawmills. These small diameter logs are cut into fire wood, chipped, or discarded.

Some wood species have desirable properties, but are not accepted by commercial sawmills. These species include pare, thorn apple, American elm, butternut, magnolia, peach, mesquite, persimmon, sassafras, birch, pecan, beech, grapefruit, sycamore, alder, olive, bass, almond, orange, dogwood, blue spruce, apricot, hickory, juniper, plum and many more. Most of these species can not be purchased anywhere except as firewood or standing trees.

Most hobby wood workers and others that work with wood have a table saw, and possibly a band saw. The table saw generally has a circular saw blade with a ten inch diameter. The saw blade may be somewhat smaller or larger in diameter. Twelve and fourteen inch diameter saw blades for table saws are available. It is also possible to obtain table saws that are capable of employing circular saw blades with diameters that exceeds fourteen inches. The saw spindle that rotates the saw blade is below a top surface of the saw table. A drive pulley on the saw spindle is also below the saw table. As a result the maximum distance that the saw blade extends above the table top surface is less than half the saw blade diameter. Two cuts are therefore required to form one flat surface on logs that are larger than the maximum cutting depth of the saw blade. One cut cuts a slot in a log. A second opposing slot in a log should intersect and be parallel to the first slot. The two cuts are ideally in a common plane to form one flat surface extending the length of the log. In the past, methods of using a table saw to mill logs have proven difficult and ineffective. Severely limited by the height of the blade and lack of a precision holding method for the log. As a result of this problem, many woods that could make attractive products have been used as fire wood or left on the ground to rot.

SUMMARY OF THE INVENTION

The table saw mill attachment includes a track assembly with at least one elongated guide bar. The guide bar is held perpendicular to a circular saw blade axis of rotation and in selected positions on one side of a circular saw blade. The track assembly is also supported by a table top surface of a table saw. A trolley assembly is connected to the at least one elongated guide bar and is movable relative to the at least one elongated guide bar between a guide bar first end and a guide bar second end.

A log holder frame assembly is pivotally attached to the trolley assembly for pivotal movement about a first log holder axis that is parallel to the at least one elongated guide bar and perpendicular to the circular saw blade axis of rotation. The log holder frame assembly is also pivotal about a second log holder axis that is perpendicular to the first log holder axis. The second log holder axis may intersect the first log holder axis. At least one elongated log retainer member is integral with the log holder frame assembly. The at least one elongated log retainer is rotatable three hundred and sixty degrees about the second log holder axis when the log holder frame assembly is pivoted about the first log holder axis to move the second log holder axis to a position substantially perpendicular to the circular saw blade axis. A log retainer tensioner end assembly with a first log centering pin is clamped to the log retainer member. A log retainer indexer end assembly is also clamped to the log retainer member. The first log centering pin and the second log centering pin are coaxial with an indexing shaft axis. The space between the first log centering pin and the second log centering pin is adjustable.

A first two pairs of mating blocks are mounted on the log holder frame and the trolley assembly. These first pairs of mating blocks cooperate to hold the indexing shaft axis in a position parallel to the path of movement of the trolley assembly when the log holder frame assembly is pivoted about the second log holder axis to a first position. A second two pairs of mating blocks are mounted on the log holder frame and the trolley assembly. These second pairs of mating blocks cooperate to hold the indexing shaft axis in a position parallel to the path of movement of the trolley assembly when the log holder frame assembly is pivoted about the second log holder axis to a second position. Each pair of mounting blocks includes one block with a groove and another block with a tongue that is received in the groove. One block of each pair of mounting blocks is adjustable to position the indexing shaft axis parallel to the path of movement of the trolley assembly.

The at least one elongated guide bar preferably includes a first elongated trolley guide rail and a second elongated trolley guide rail. The first and second trolley guide rails are spaced apart. A pair of spaced apart first side wheels journaled on the trolley assembly engages the first elongated trolley guide rail. A pair of spaced apart second side wheels journaled on the trolley assembly engages the second guide rail. Each of the pair of spaced apart first side wheels include a groove that engages the first elongated trolley guide rail and guide the trolley assembly parallel to the first elongated trolley guide.

An elongated center trolley guide rail is positioned between and parallel to the first elongated trolley guide rail and the second elongated trolley guide rail. A trolley hold down car is attached to the trolley assembly. A hold down roller attached to the trolley hold down car engages the elongated center trolley guide rail and holds the pair of spaced apart first side wheels in engagement with the first elongated trolley guide rail. The hold down roller also holds the pair of spaced apart second side wheels in engagement with the second elongated trolley guide rail. There are preferably two hold down cars attached to the trolley assembly and adjustable relative to the trolley assembly to maintain engagement between the trolley assembly and both trolley guide rails.

At least two spaced apart guide support bars are fixed to the first elongated trolley guide rail and the second elongated trolley guide rail. Both of the spaced apart guide support bars are engageable with a table saw fence to position the indexing shaft axis in selected positions relative to the circular saw blade.

The at least one elongated log retainer member includes two space apart beams. The log retainer tensioner end assembly includes a tensioner shank that is received between the two spaced apart beams and is clamped to the two spaced apart beams in a selected position along the length of the two spaced apart beams. A threaded bore through the tensioner shank receives a threaded tensioner rod. The first log centering pin is pivotally supported on and coaxially with the threaded tensioner rod. The log retainer indexer end assembly includes an indexer shank that is received between the two space apart beams and clamped to the two spaced apart beams. An indexing shaft is journaled in a passage through the indexer shank. An indexer block, with at least four indexing recesses, is fixed to an end of the indexing shaft. An indexing lock is selectively engageable with each of the at least four indexing recesses. The second log centering pin is secured to another end of the indexing shaft and coaxial with the indexing shaft.

The log retainer indexer end assembly is clamped to the spaced apart beams in selected positions along the length of the two spaced apart beams.

During use of table saw mill attachment, a log is manually moved parallel to the indexing shaft axis toward the circular saw blade and a first groove is cut into the log extending from the first end to the second end of the log. The log is returned to the starting position. The position of the first end and the second end of the log is reversed. The log is then manually moved parallel to the indexing shaft axis toward the circular saw blade. A second groove is cut in the log extending from the second end to the first end of the log and intersecting the first groove to form a first flat surface on the log. The log is then returned to the starting position.

The log can be released by the indexer assembly, pivoted about the indexing shaft axis, and locked in place by the indexer shaft assembly. The above steps can be repeated to form a second flat surface. Four flat surfaces can be cut to form a member with a square cross section. Eight flat surfaces may be cut to form an eight sided beam if desired. Further shapes may be formed by changing the position of the indexing shaft axis along the circular saw blade axis of rotation and/or changing the position of the guide rail assembly in relation to the table top surface of the table saw.

BRIEF DESCRIPTION OF DRAWINGS

The presently preferred embodiment of the invention is disclosed in the following description and in the following drawings, wherein:

FIG. 12 is a perspective view of the trolley assembly;

FIG. 13 is a top and bottom views of the trolley assembly with parts broken away;

DETAILED DESCRIPTION OF THE PREFERRED EMBODIMENTS

Figure 1:
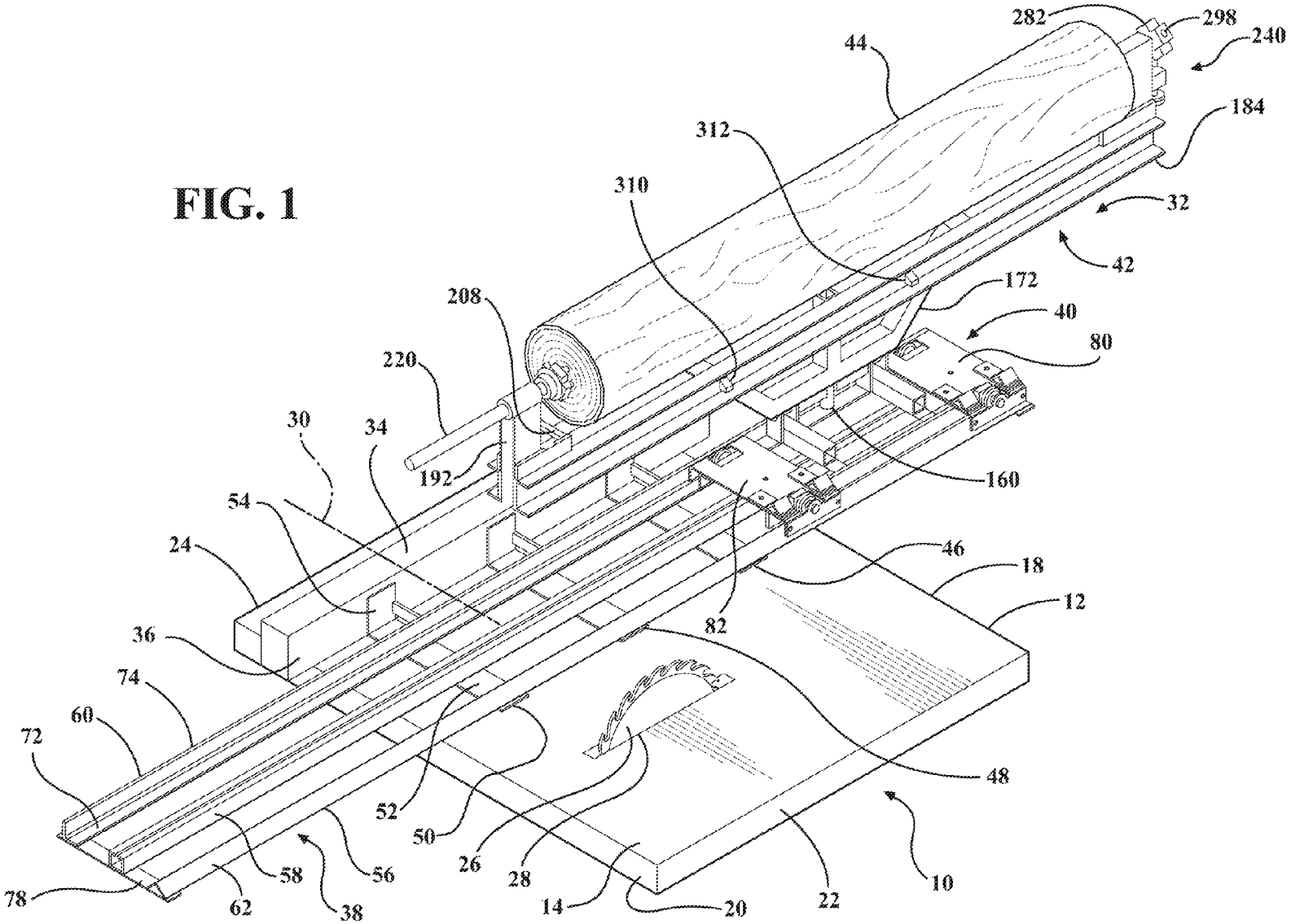
FIG. 1 is a perspective view of the table saw attachment mounted on a table saw with the log holder in a raised position.

A table saw 10 includes a table 12 with a top surface 14. The top surface 14 is in a flat plane 16. The flat plane 16 is generally horizontal but may be tilted if desired. The table 12 has a first end 18, a second end 20, a left side 22, and a right side 24. A circular saw blade 26 extends through a slot 28 through the table 12. The circular saw blade 26 is clamped to a blade shaft (not shown) supported by bearings. The axis of rotation 30 of the blade shaft is parallel to the top surface 14 of the table 12 as shown in the drawing Figures. The blade shaft on most table saws 10 is vertically adjustable relative to the top surface 14 of the table 12. The blade shaft may also be pivoted about an axis normal to the axis of rotation 30 and parallel to the top surface 14 of the table 12. The axis of rotation 30 of the blade shaft is parallel to the top surface 14 and the circular saw blade 26 is in a raised position when used with the square mill attachment 32. A table saw fence 34 is adjustably secured to the table 12. The table saw fence 34 includes a fence guide surface 36 that extends away from the top surface 14 at a ninety degree angle relative to top surface. The fence guide surface 36 is also normal to the axis of rotation 30 of the blade shaft. The fence 34 is adjustable to change the distance between the fence guide surface 36 and the circular saw blade 26.

The square mill attachment 32 includes a trolley guide rail assembly 38, a trolley assembly 40, and a log holder frame assembly 42. A log 44 is held by the log holder frame assembly 42 during employment of the square mill attachment 32.

Figure 11:
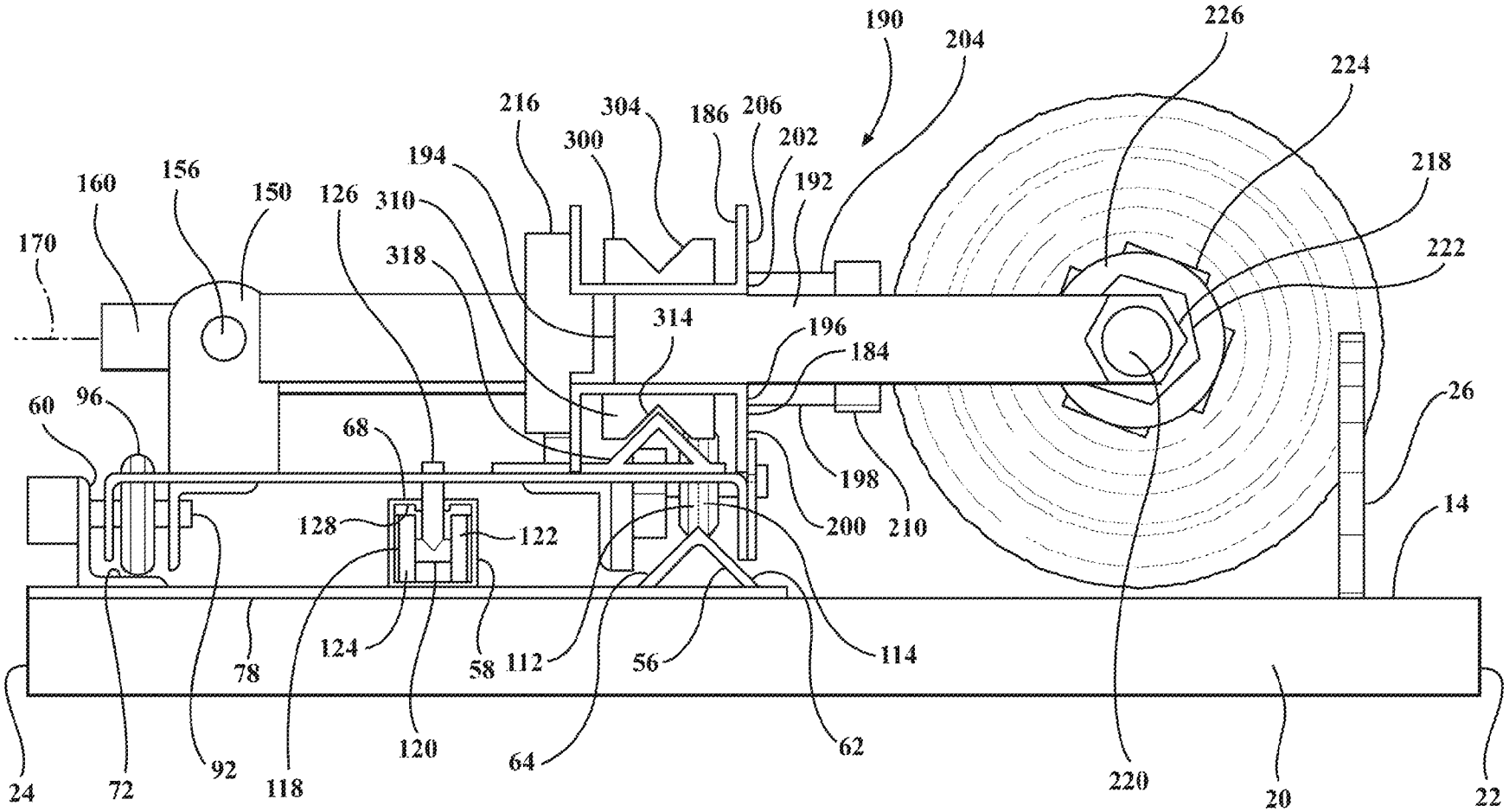
FIG. 11 is an enlarged end view of the table saw attachment with the log holder and trolley in the position shown in FIG. 3.

The trolley guide rail assembly 38 includes guide support bars 46, 48 and 50. Each of the support bars 46, 48 and 50 has an elongated portion 52 that is supported by the table 12 and is parallel to the table top surface 14. Each support bar 46, 48 and 50 has an integral end portion 54 that engages the fence guide surface 36 and is parallel to the guide surface. The end portions 54 extend perpendicular to elongated portion 52. Three spaced apart trolley guide rails 56, 58 and 60 are supported by and fixed to the elongated portion 52 of each bar 46, 48 and 50. The left trolley guide rail 56 is an elongated angle iron member with an inverted V-shaped cross section. Trolley guide surfaces 62 and 64 on the trolley guide rail 56 face away from the elongated portion 52 of each bar 46, 48 and 50 of the trolley guide rail assembly 38 as shown in FIG. 11. The center trolley guide rail 58 is an elongated tube with a rectangular cross section. A bottom wall 66 of the guide rail 58 is fixed to the elongated portion 52 of each support bar 46, 48 and 50. A top wall 68 of the center trolley guide rail 58 has a center slot 70. The center slot 70 extends the length of the center trolley guide rail 58. The right trolley guide rail 60 is an elongated angle iron. A roller support portion 72 of the right guide rail 60 is fixed to the elongated portion 52 of each guide bar 46, 48 and 50. A vertical portion 74 of the guide rail 60 extends the length of the guide rail and is normal to the roller support portion 72. A first end guide rail plate 76 is fixed to the lower surface the trolley guide rails 56, 58 and 60. A second end guide rail plate 78 is fixed to the lower surface of the trolley guide rails 56, 58 and 60. The first end guide rail plate 76 cooperates with the second end guide rail plate 78 to hold the trolley guide rails 56, 58, and 60 parallel to each other and spaced apart.

The trolley assembly 40 includes a first trolley end member 80 and a second trolley end member 82. Both trolley end members 80 and 82 include a center plate portions 84 an integral left flange 86 and right integral flange 88. The left and right flanges 86 and 88 extend downward from the center plate portions and form channel shaped members. An angle iron 90 is fixed to the first trolley end member 80 and the second trolley end member 82 and spaced from the integral right flanges 88. Roller pins 92 pass through bores through the angle iron 90 and the right integral flanges 88 of the first trolley end member 80 and the second trolley end member 82. A first trolley roller 94 is journaled on the roller pin 92 attached to the first trolley end member 80. A second trolley roller 96 is journaled on the roller pin 92 attached to the second trolley end member 82. A trolley bar 98 is fixed to the first trolley end member 80 and the second trolley end member 82 and spaced from the integral left flanges 86. V-wheel pins 100 are supported by the vertical bar 98 and the left integral flange 86 on both trolley end members 80 and 82. As shown in FIG. 12, the V-wheel pins 100 pass through bores through blocks 102 and 104. Blocks 102 are fixed to integral left flanges 86 of the first trolley end member 80 and the second trolley end member 82. The blocks 104 are fixed to the trolley bar 98. A pair of V-shaped wheels 106 and 108 is journaled on a V-wheel pin 100 and extends through an aperture 110 through the first trolley end member 80. A pair of V-shaped wheels 112 and 114 are journaled a V-wheel pin 100 and extend through an aperture 116 through the second trolley end member 82.

The V-shaped wheels 106 and 112 engage the trolley guide surfaces 64 and 62 of the left trolley guide rail 56, as shown in FIG. 11 when the trolley assembly 40 is mounted on the guide rail assembly 38. The V-shaped wheels 108 and 114 engage the trolley guide surfaces 62 and 64 of the left trolley guide rail 56. The first trolley roller 94 and the second trolley roller 96 engage the roller support portion 72 of the right trolley guide rail 60. Trolley hold down cars 118 includes a housing 120. Wheels 122 and 124 are journaled on opposite sides of the housing 120 for rotation about a common axis. A shank 126 is fixed to the housing 120 and extends from between the wheels 122 and 124. The wheels 122 and 124 and the housing 120 are received in the center trolley guide rail 58. The shank 126 extends through the center slot 70 in the top wall 68 of the center trolley guide rail 58. There are two trolley hold down cars 118. The shank 126 of one trolley hold down car 118 extends through a bore through the first trolley end member 80. A trolley adjustment nut 130 screws onto a threaded end of the shank 126 that extends through the first trolley end member 80. The trolley adjustment nut 130 is tightened until the wheels 122 and 124 engage the inside surface 128 of the top wall 68, of the center trolley guide rail 58, the V-shaped wheels 106 and 108 engage the left trolley guide rail 56, and the first trolley roller 94 engages the roller support arm portion 72 of the right guide rail 60. A trolley adjustment nut 132 screws onto a threaded end of the shank 126 that extends through the second trolley end member 82. The trolley adjustment nut 132 is tightened until the wheels 122 and 124 engage the inside surface 128 of the top wall 68 of the center trolley guide rail 58, the V-shaped wheels 112 and 114 engage the left trolley guide rail 56 and the second trolley roller 96 engages the roller support arm portion 72 of the right guide rail 60.

The log holder frame assembly 42 includes two holder support bars 140 and 142 that are secured to the trolley assembly 40. The support bars 140 and 142 are spaced apart and are transverse to the trolley guide rails 56, 58 and 60. The holder support bar 140 has shaft support plates 144 and 146 connect to opposite sides adjacent to the angle iron 90. The holder support bar 142 has shaft support plates 148 and 150 connected to opposite sides adjacent to the angle iron 90. A trunnion assembly 152 is pivotally attached to a pivot pin 154 and a pivot pin 156. The pivot pin 154 is secured to the shaft support plates 144 and 146. The pivot pin 156 is secured to the shaft support plates 148 and 150. The trunnion assembly 152 is pivotally about a first log holder axis 158. A cylindrical pipe 160 is welded to tubes 162 and 164 of the trunnion assembly 152 mid way between the shaft support plate 146 and the shaft support plate 148. A log holder pivot shaft 166 is journaled is journaled in the cylindrical pipe 160 for pivotal movement about a second axis 170. The second axis 170 intersects the first log holder axis 158 and is perpendicular to the first log holder axis.

A log holder frame 172 is fixed to the log holder pivot shaft 166 and is rotatable about the second log holder axis 170 with the log holder pivot shaft. The log holder frame 172 includes a base frame tube 174 that is secured directly to the log holder pivot shaft 166. A first end tube 176 is integral with a first end of the base frame tube 174. A second end tube 178 is integral with a second end of the base frame tube 174. The first end tube 176 and the second end tube 178 extend away from the first log holder axis 158 and diverge from each other. A center tube 180 is welded to the base frame tube 174 and is coaxial with the second log holder axis 170. The center tube 180 extends away from the first log holder axis 158 in the same direction as the first and second end tubes 176 and 178. A log support frame assembly 182 is fixed to the free ends of the first end tube 176, the center tube 180 and the second end tube 176. The log support frame assembly 182, as shown in the drawing figures, includes a first elongated channel iron member 184 and a second elongated channel iron member 186. The first and second elongated channel iron members 184 and 186 are attached to opposite sides of the tubes 176, 178 and 180. The first and second elongated channel iron members 184 and 186 are separated from each other by a dimension of the log holder frame 172 and are parallel to each other.

A log retainer tensioner end assembly 190, shown in FIG. 11, has a shank 192. The shank 192 has a lower end 194 that is received between the first elongated channel 184 and the second elongated channel member 186. A bottom surface 196, on a bar 198, engages the top surface 200 on the first elongated channel member 184. A bottom surface 202, on a bar 204, engages the top surface 206 on the second elongated channel member 186. The bar 198 and the bar 204 are fixed to the shank 192. An angled plate 208 is welded to the shank 192, the bar 198, and the bar 204. A block 210 with a threaded bore is positioned on top of the bars 198 and 204 below the angled plate 208. A bolt 214 shown in FIG. 14 passes through a plate 216 shown in FIG. 7, passes between the first and second elongated channel members 184 and 186, and screws into the threaded bore in block 210. The bolt 214 is tightened to hold the bars 198 and 204 in selected positions along the length of the first and second elongated channel members 184 and 186. An elongated nut 218 is fixed to the top of the shank 192. A threaded tensioning rod 220 is screwed into the elongated nut 218. A hexagon shaped plate 222 is fixed to the rod 220. A log retainer plate 224 is journaled on the threaded rod 220. A thrust bearing 226 is provided between the hexagon shaped plate 222 and the log retainer plate 224. A centering pin 274 with a conical surface 275 is attached to the log retainer plate 224 and is coaxial with the threaded tensioning rod 220. Four stop pins 232 are fixed to the log retainer plate 224 and radially spaced equal distances from the centering pin 274. The hexagon shaped plate 222 is rotated to advance the log retainer plate 224 and advance the centering pin 274 into a bore drilled into the center of a log end. The stop pins 232 engage the end of a log to limit penetration of the centering pin 274.

Figure 7:
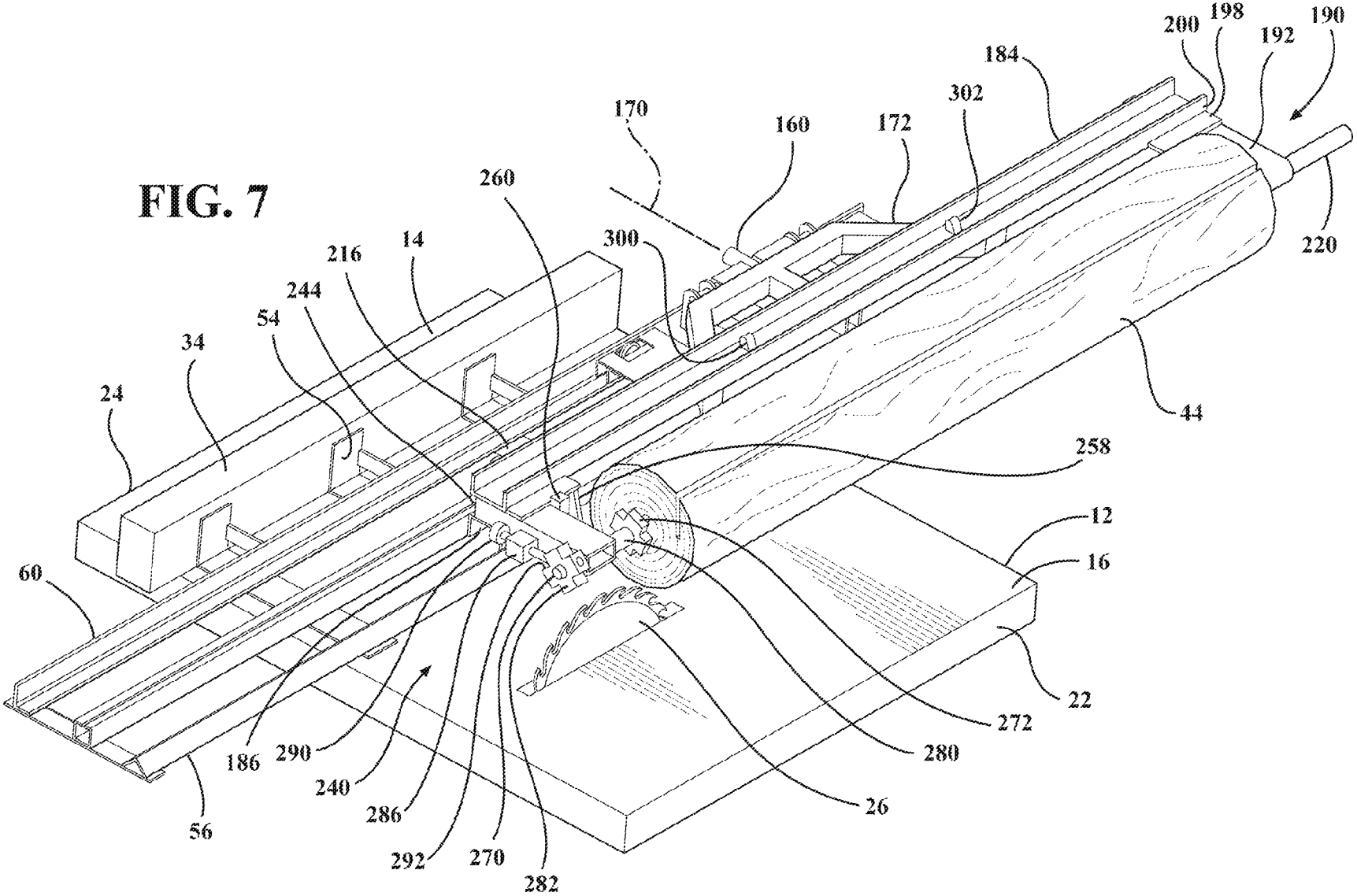
FIG. 7 is a perspective view similar to FIG. 2, with a second cut in the log ready to start.
Figure 8:
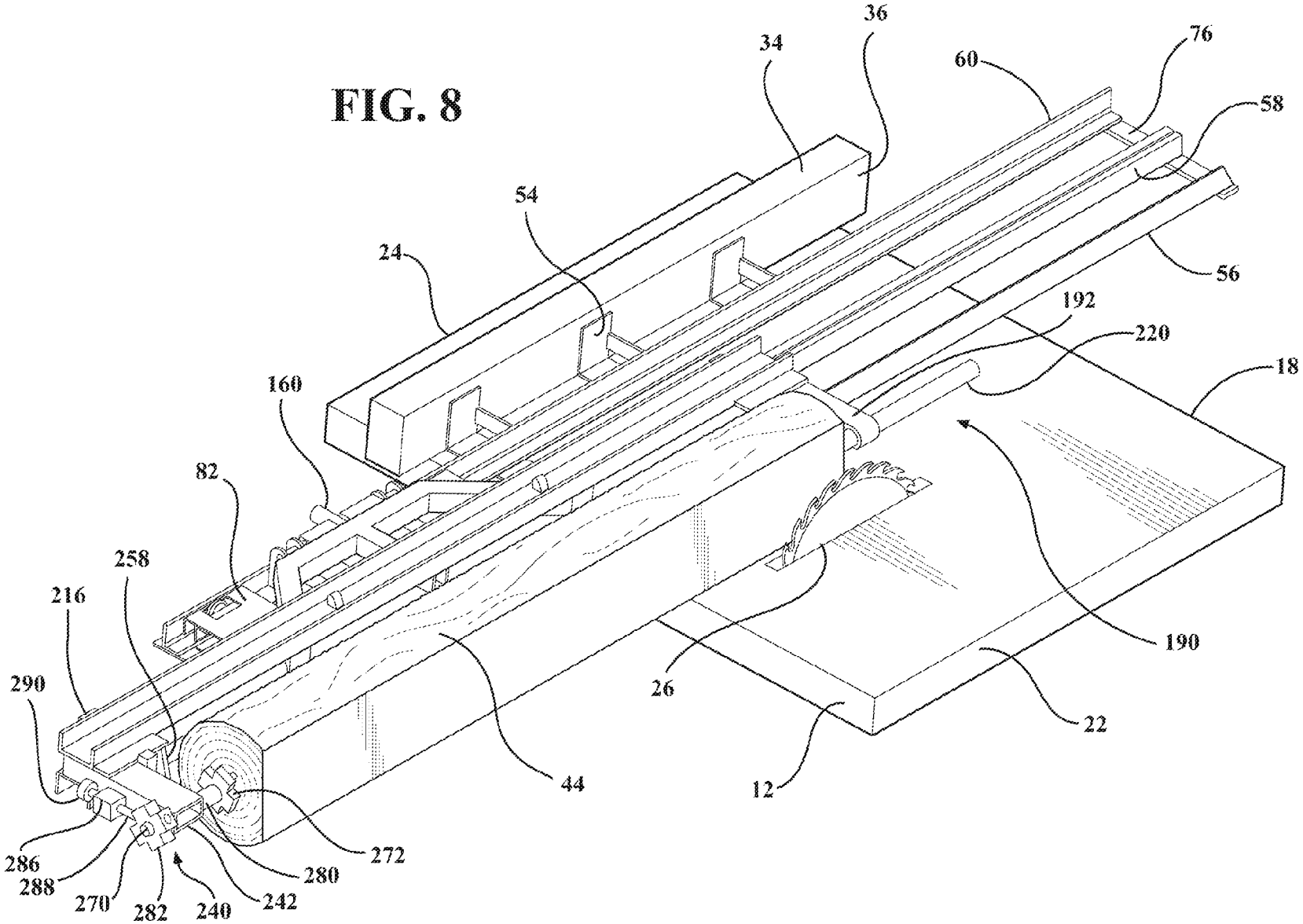
FIG. 8 is a perspective view similar to FIG. 4, with the second cut finished.
Figure 9:
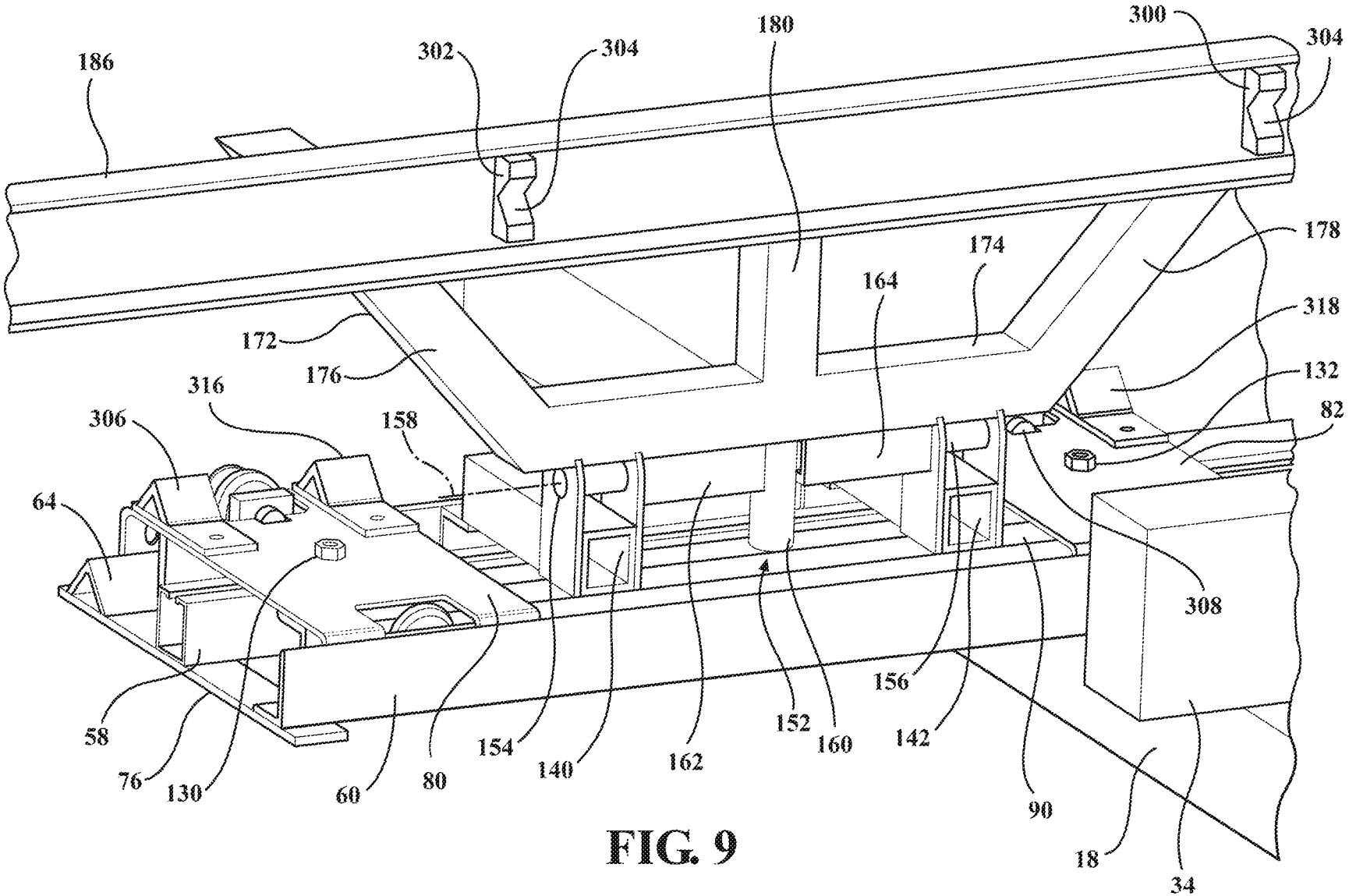
FIG. 9 is an enlarged, perspective view with parts broken away and showing the pivot connections between the log holder and a trolley and the log holder frame in the up position.
Figure 10:
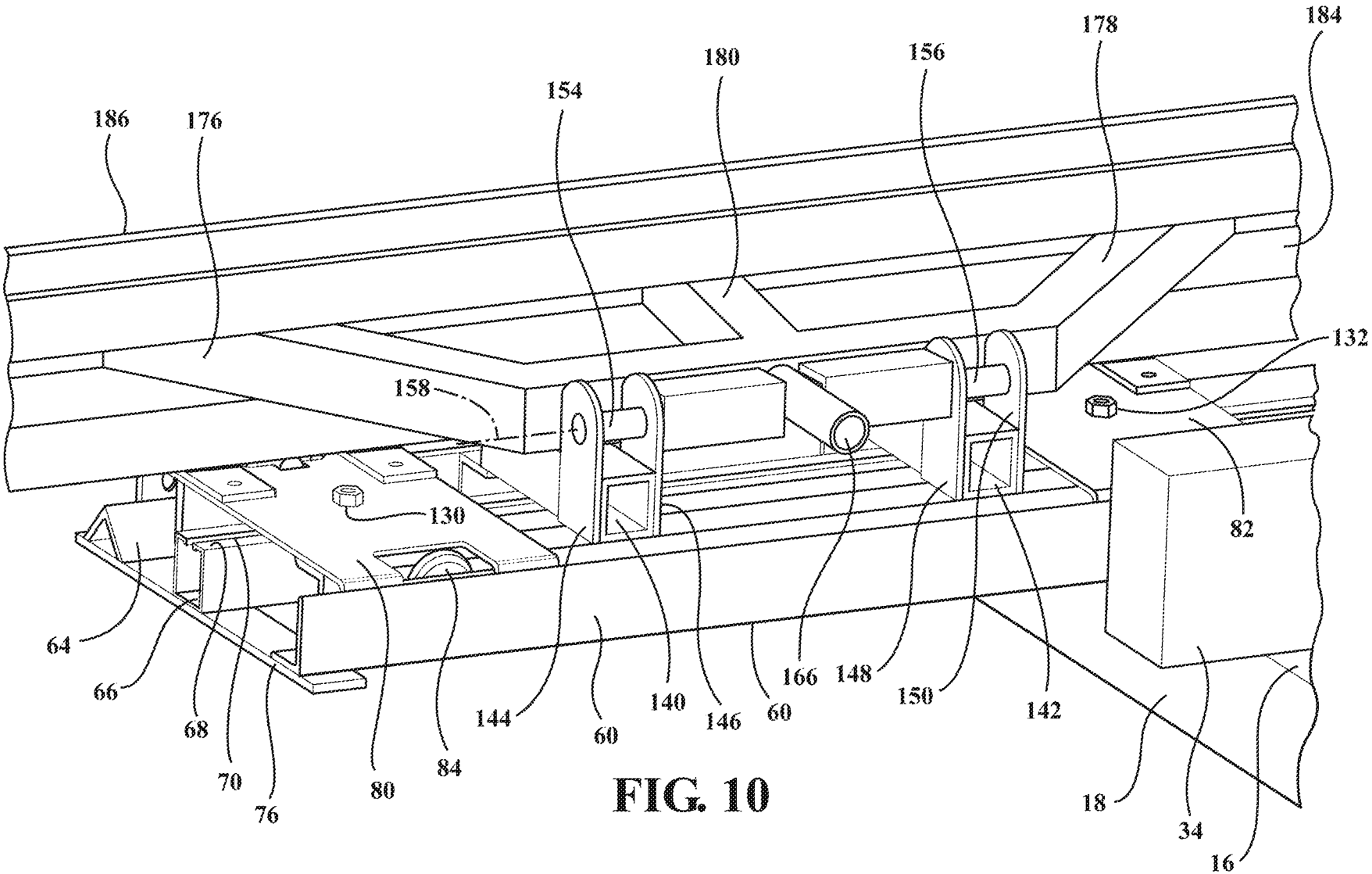
FIG. 10 is an enlarged perspective view similar to FIG. 9, with the log holder in the position shown in FIG. 2.

A log retainer indexer end assembly 240, shown in FIG. 7, has a shank 242. The shank 242 has a lower end 244 that is received between the first elongated channel member 184 and the second elongated channel member 186. A bottom surface 246 on a bar 248, engages the top surface 200 on the first elongated channel member 184. A bottom surface 252, on a bar 254, engages the top surface 206 on the second elongated channel member 186. The bar 248 and the bar 254 are fixed to the shank 242. An angled plate 258 is welded to the shank 242, the bar 248 and the bar 254. A block 260 with a threaded bore 262 is positioned on top of the bars 248 and 254 below the angled plate 258. A bolt 214 passes through a plate 216, passes between the first and second elongated channel members 184 and 186, and screws into the threaded bore in block 260. The bolt 214 is tightened to hold the bars 248 and 254 in selected positions along the length of the first and second elongated channel members 184 and 186. A tube 268 passes through an upper portion of the shank 242. An indexing shaft 270 is journaled in the tube 268. A log retaining plate 272 is fixed to one end of the indexing shaft 270. A centering pin 274 with a conical surface 275 is fixed to the log retaining plate 272. Four stop pins 276 are fixed to the log retainer plate 272 and radially spaced equal distances from the centering pin 274. The stop pins 276 include end surfaces 278 that engage the end of a log and prevent rotation of a log relative to the indexing shaft 270. A thrust bearing 280 is mounted on the indexing shaft 270 between log retainer plate 272 and the fixed tube 268. An indexing block 282 is mounted on the end of the indexing shaft 270 opposite the centering pin 274. The indexing block 282 and the log retaining plate 272 are secured to the indexing shaft 270 and do not rotate relative to each other. A lock nut axially secures the indexing block 282 to the indexing shaft 270. The indexing block 282 is adjacent to an end of the fixed tube 268 to minimize axial movement of the indexing shaft 270 relative to the fixed tube 268. A block 286 with a threaded bore is fixed to the shank 242 as shown in FIG. 8. A threaded rod 288 is rotated by a knob 290 and advanced through the threaded bore in the block 286. A wedge member 292 on the free end of the threaded rod 288 is advanced into one of the four V-shaped recesses 294 in the radially outer edges of the indexing block 282. The V-shaped recesses 294 are spaced ninety degrees apart about the indexing shaft axis 296. Four radial extending bores 298 are also provided in the indexing block 282. The radially extending bores 298 are spaced ninety degrees from each other about the indexing shaft axis 296. The radially extending bores 298 are also spaced forty five degrees about the indexing shaft axis 296 from each adjacent V-shaped recess 294. The wedge member 292 on the threaded rod 288 can be advanced into each radially extending bore 298 by rotating the knob 290 to fix the indexing shaft 270 in selected positions. The wedge member 292 preferably has a maximum diameter that exceeds the diameter of the radially extending bores 298.

During use of the square mill attachment 32, the trolley guide rail assembly 38 is positioned on the top surface 14 of the table 12 of a table saw 10. The integral end portions 54 of the guide support bars 46, 48 and 50 are moved into engagement with the fence guide surface 36 of the saw fence 34. Clamps (not shown) clamp the integral end portions 54 to the fence 34. The elongated portions 52 of the guide support bars 46, 48 and 50 remain in engagement with the top surface 14 and are held down by the weight of the trolley guide rail assembly 38. The table saw fence 34 remains laterally adjustable toward or away from the circular saw blade 26 together with the trolley guide rail assembly 38. The table saw fence 34 includes locks (not shown) for locking the fence 34 in selected position. A log 44 is positioned between the log retainer tensioner end assembly 190 and the log retainer indexer end assembly 240. Bores, drilled into both ends of the log 44, receive the centering pins 228 and 274. The hexagon shaped plate 222 is rotated to advance the log retainer plate 224 toward the log retainer plate 272 and fix the position of the log 44 between both retainer plates. The threaded tensioning rod 220 provides limited movement of the log retainer plate 224 along the indexing shaft axis 296. It may be necessary to adjust the space between the log retainer tensioner end assembly 190 and the log retainer indexer end assembly 240 by loosening one of the bolts 214, moving one of the assemblies along the first and second elongated channel members 184 and 186, and then retightening the bolt 214. The head of bolt 214 is in a counter bore in the plate 216.

Figure 2:
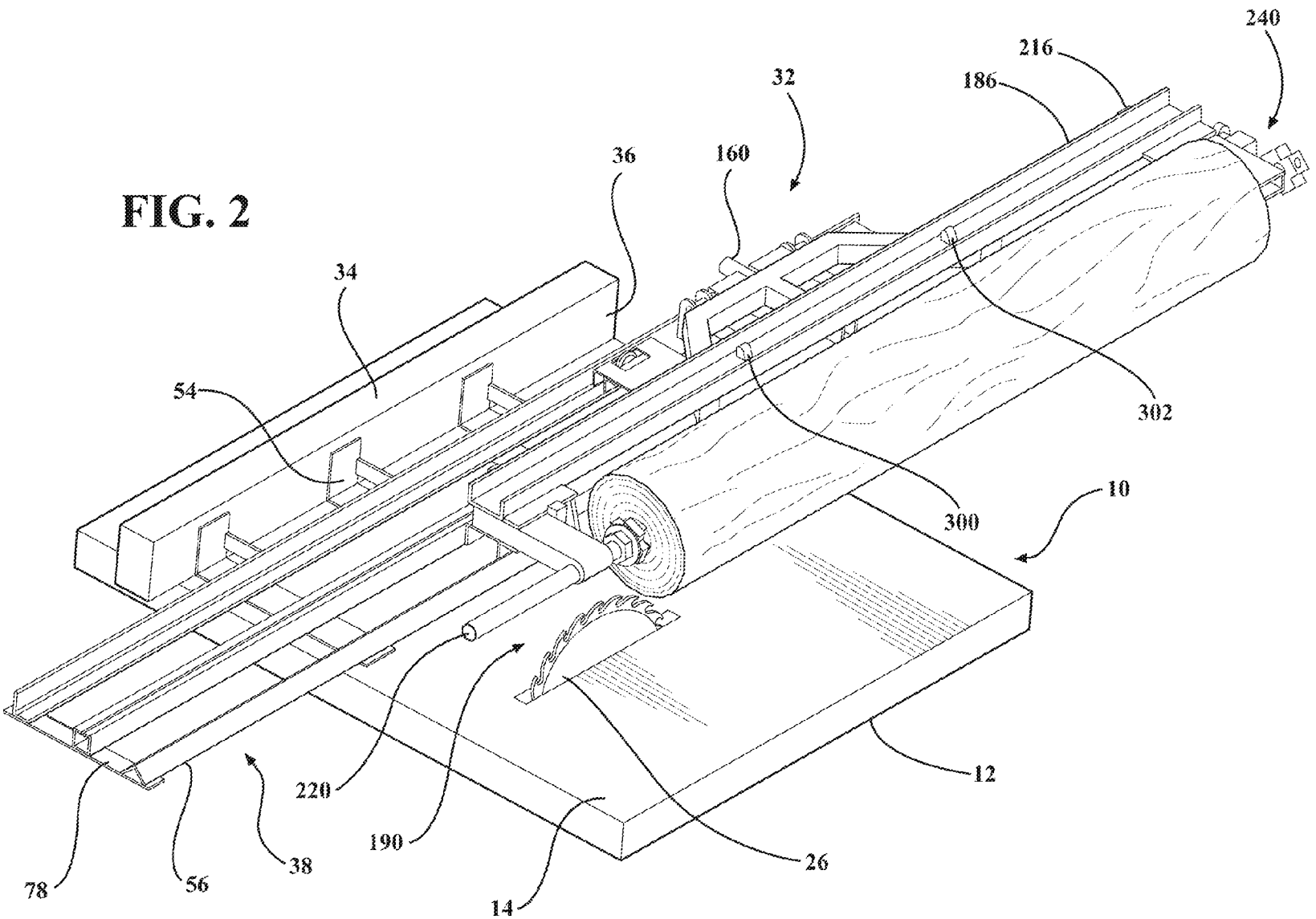
FIG. 2 is a perspective view similar to FIG. 1 with the log holder in the laid down position and ready to be cut.
Figure 3:
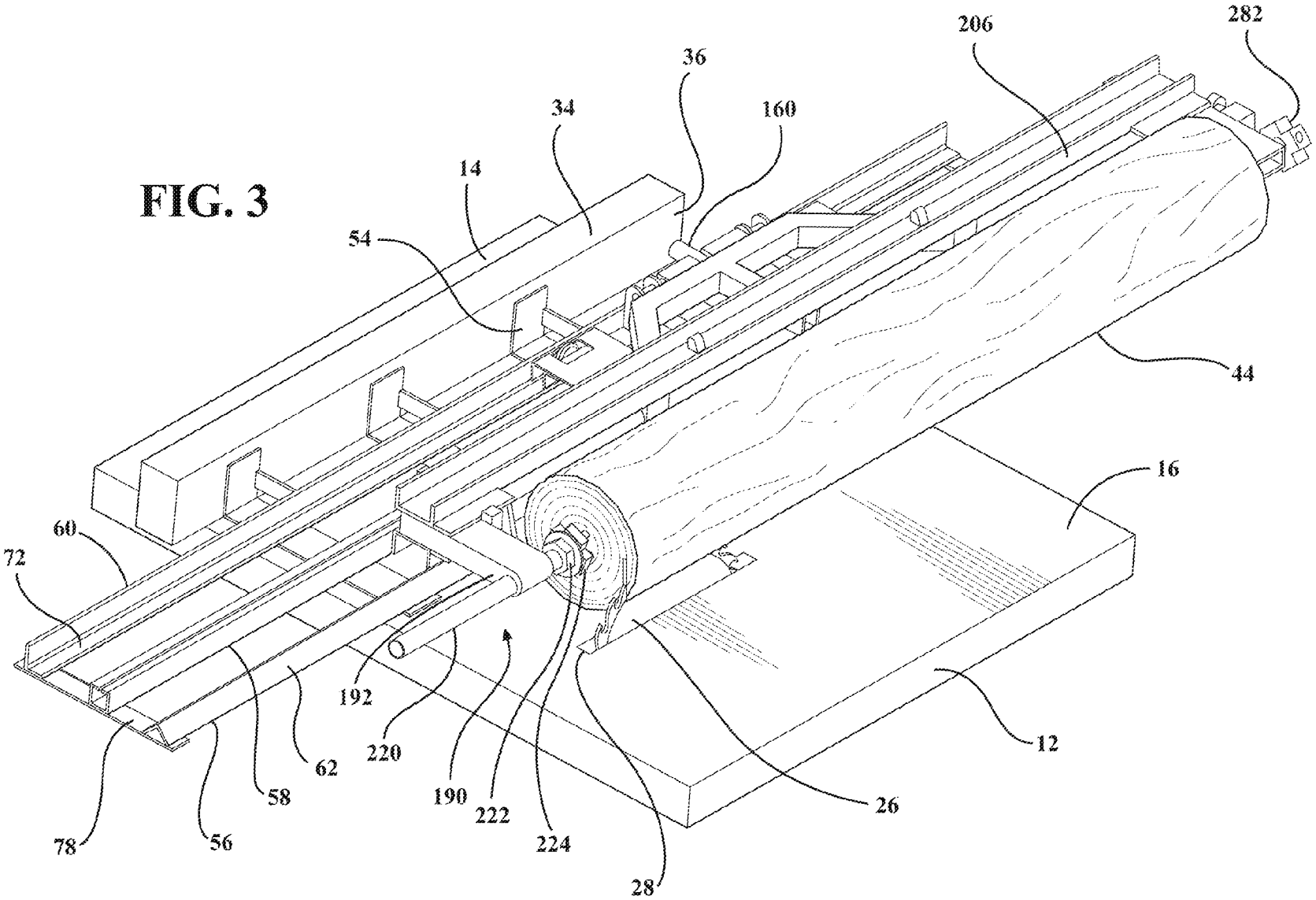
FIG. 3 is a perspective view similar to FIG. 2 with a first cut started in a log.
Figure 4:
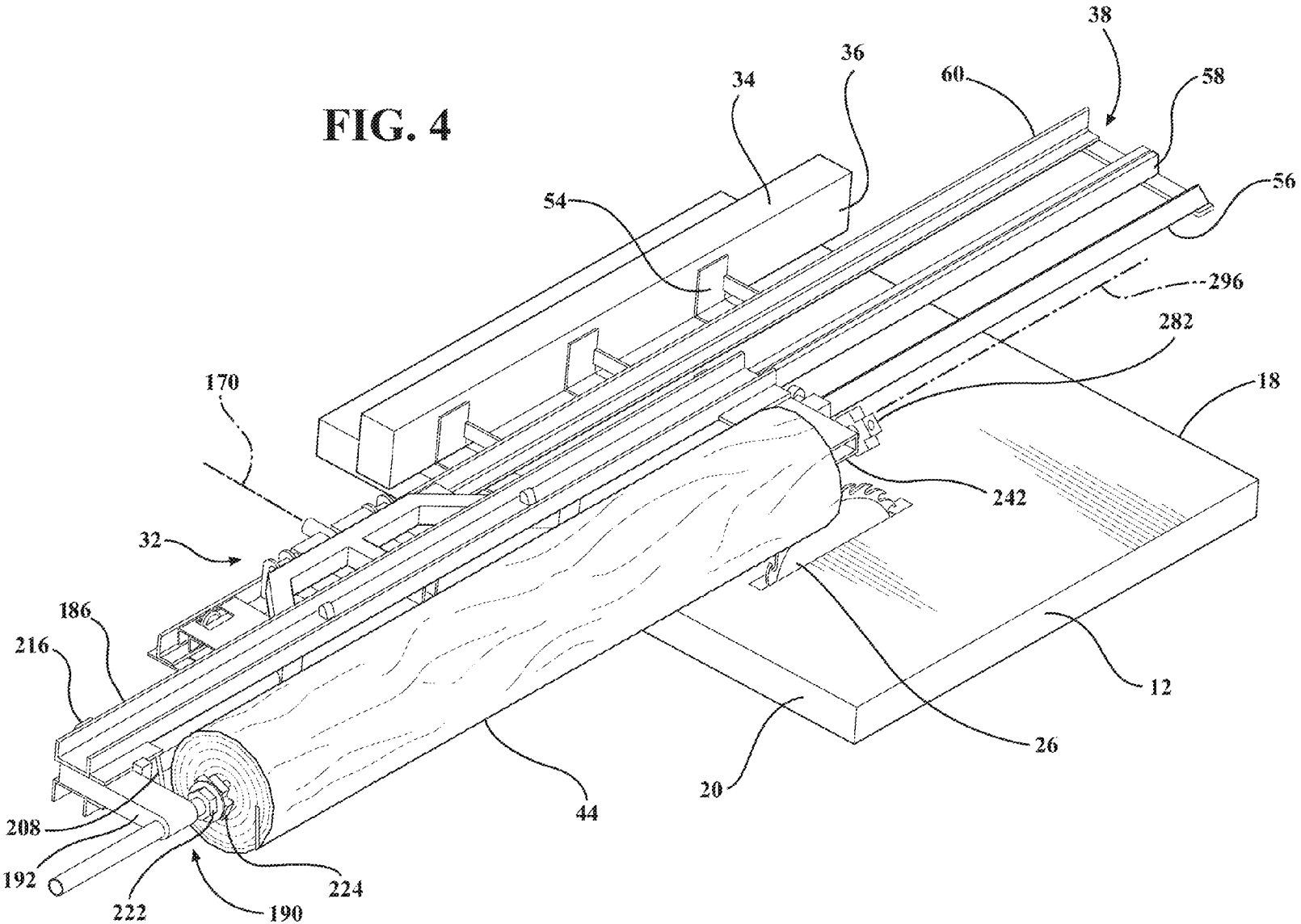
FIG. 4 is a perspective view similar to FIG. 4 with the first cut substantially finished.
Figure 6:
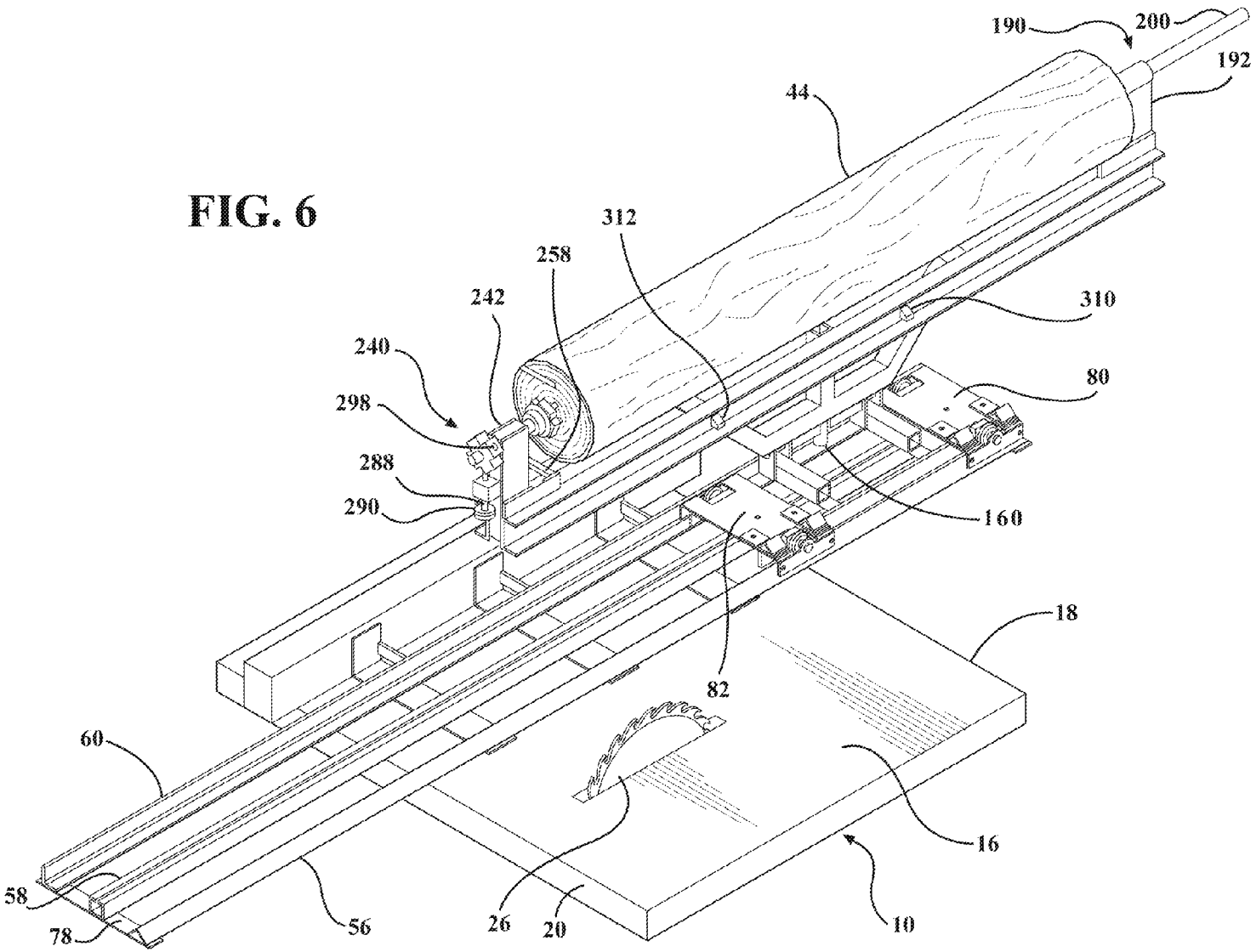
FIG. 6 is a perspective view similar to FIG. 5, with the log holder frame rotated 180° from the position shown in FIG. 1.

The log holder frame 172 is rotated about the first log holder axis 158 from the position shown in FIGS. 2 and 11, to the position shown in FIGS. 1 and 6. When the log holder frame 172 is in the position shown in FIGS. 2 and 11, mating guide blocks 300 and 302 with recesses 304 receive V-block projections 306 and 308 shown in FIG. 12. The V-block projections 306 and 308 are adjustably clamped to the second trolley end member 82 and the first trolley end member 80 respectively. The V-block projections 306 and 308 and the mating guide blocks 300 and 302 attached to the first elongated channel member 184 hold the indexing shaft axis 296 parallel to the left trolley guide rail 56. The log holder frame 172 is clamped (not shown) to the trolley assembly 40. The trolley assembly 40 is advanced along the trolley guide rail assembly 38 to make a first cut in the log 44 as shown in FIGS. 3 and 4.

Figure 5:
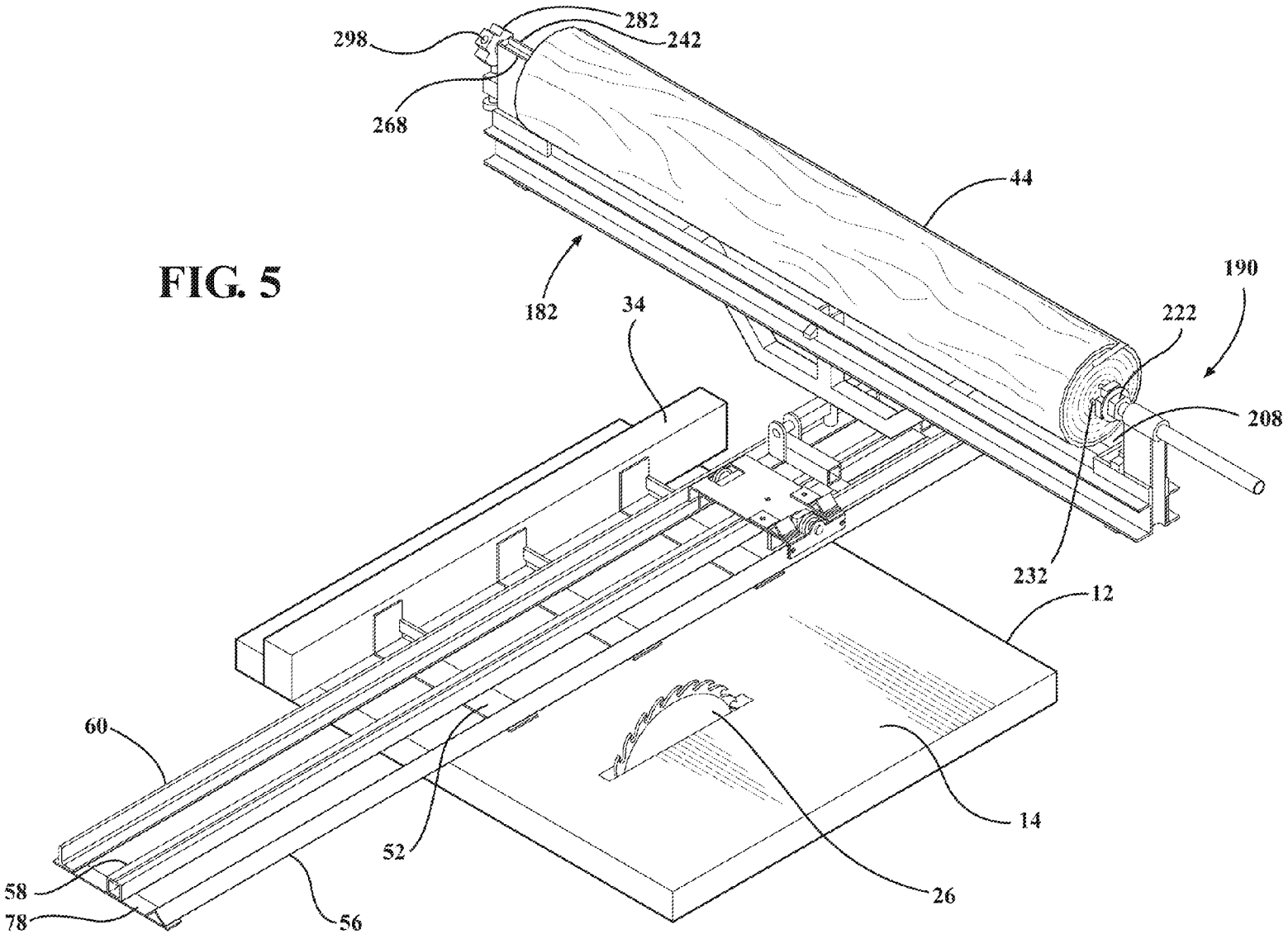
FIG. 5 is a perspective similar to FIG. 1, with the log holder frame partially rotated.

The log holder frame 172 is unclamped from the trolley assembly 40 and pivoted about the first log holder axis 158 to the substantially vertical position shown in FIG. 1. The log holder frame 172 is then pivoted about second log holder axis 170 of the log holder pivot shaft 166 and the cylindrical pipe 160 as shown in FIGS. 5 and 6. After pivoting one hundred and eighty degrees, the log holder frame 172 is pivoted about the first log holder axis 158 from the position shown in FIG. 6 to the position shown in FIG. 7. The log holder frame 172 is clamped to the trolley assembly 40. Mating blocks 310 and 312 with recesses 314 are fixed to the second elongated channel member 186. The recesses 314 receive the V-block projections 316 and 318, when the log holder frame 172 is in the position shown in FIGS. 7 and 8 receive the V-block projections 316 and 318 respectively. The clamp that clamps the log holder frame 172 to the trolley frame assembly 40 maintains engagement between the V-block projections 316 and 318 and the recesses 314 in the mating blocks 310 and 312. The V-block projection 318 on the first trolley member 80 is adjustable relative to the first trolley member. The V-block projections 316 and 318 cooperate with mating blocks 310 and 312 to hold the indexing shaft axis 296 parallel to the left trolley guide rail 56 and in alignment with the first cut. The log holder frame 172, as shown in FIG. 7 is in position for the trolley assembly 40 to be advanced and start the second cut. FIG. 8 shows the position of the trolley assembly at the completion of the second cut. After the second cut is completed, the log 44 is indexed about the indexing shaft axis 296, locked in place by the threaded rod 288 and the wedge member 292 and two more cuts are made as described above.

A table saw 10 with a larger diameter circular saw plate can be accommodated by providing gauge blocks 291 between the top surface 14 of the table 12 and the elongated portions 52 of the guide bars 46, 48 and 50. The gauge blocks raise the trolley guide rails 56 and 60 from the position shown in FIG. 1. The gauge blocks are clamped to guide bars 46, 48 and 50 to insure continuous support during employment of the square mill attachment 32.

Figure 14:
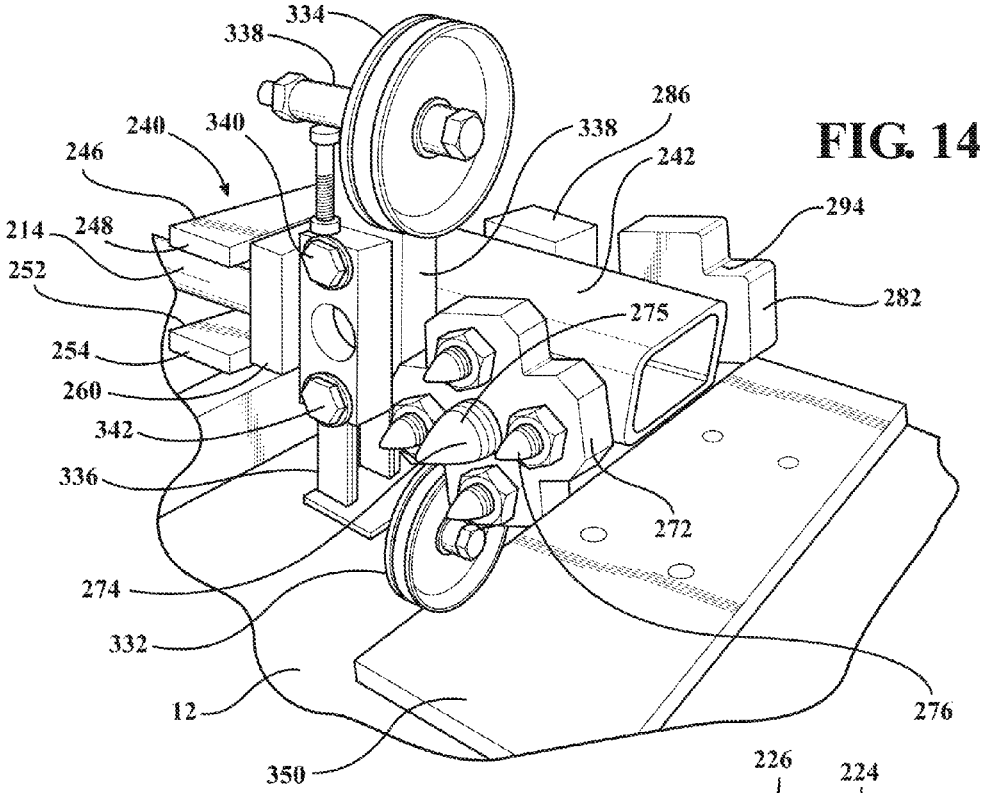
FIG. 14 an enlarged perspective view of the index end log holder arm with supports for a larger log.
Figure 15:
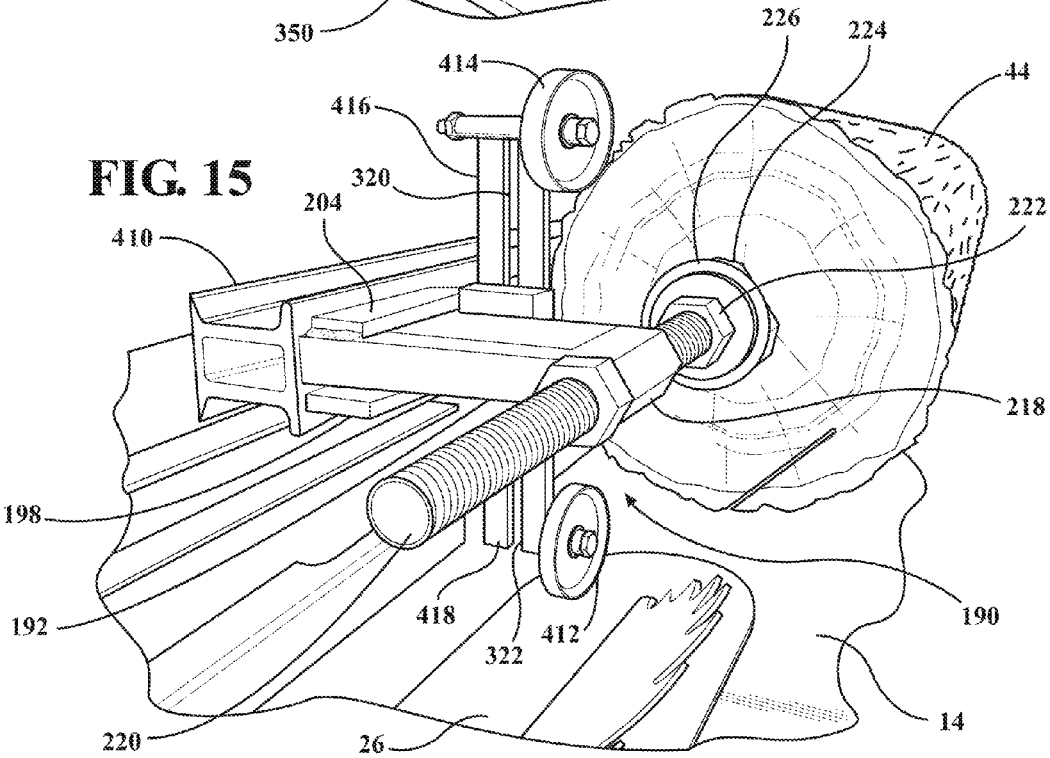
FIG. 15 is an enlarged perspective view of the tensioner end of the log holder arm after one groove has been cut in a larger diameter log.

Logs 44 with increased length can be accommodated by extensions to the length of the table 12. Extensions 350 to one end of the table 12 is shown in FIG. 14. The length of the rails 184 and 186 are replaced by a beam 410 with increased length and strength as shown in FIGS. 14 and 15. Support rollers 412 and 414 are secured to the log retainer tensioner end assembly 190 by plates 416 and 418. The plates 416 and 418 have slots 320 and 322 for the passage of bolts that clamp the plates to tensioner end assembly 190. The slots 320 and 322 permit adjustment of the position of the rollers 412 and 414. The support rollers 412 and 414 roll on the surface of plates 350 that are in the same plane 16 of the table top surface 14.

Support rollers 332 and 334 are journaled on bearings secured to adjustment brackets 336 and 338 by bolts 340 and 342. Bolts 340 and 342 clamp the adjustment brackets 336 and 338 to the log retainer indexer end assembly 240. The bolts 340 and 342 permit adjustment of the positions of the support rollers 332 and 334. The support rollers 432 and 434 roll on the surface of plates 350 that are in the plane 16 of the table top surface 14. Plates 350 are provided on the table extensions of both ends of table 12

I claim:

1. A table saw mill attachment comprising:

a track assembly with at least one elongated guide bar that is held perpendicular to a circular saw blade axis of rotation and on one side of a circular saw blade and supported by a table top surface of a table saw;

a trolley assembly connected to the at least one elongated guide bar and movable relative to the at least one elongated guide bar between a guide bar first end and a guide bar second end;

a log holder frame assembly pivotally attached to the trolley assembly for pivotal movement about a first log holder axis that is parallel to the at least one elongated guide bar and for pivotal movement about a second log holder axis that is perpendicular to the first log holder axis, and at least one elongated log retainer member integral with the log holder frame assembly and rotatable three hundred and sixty degrees about the second log holder axis when the log holder frame assembly is pivoted about the first log holder axis to move the second log holder axis to a position substantially perpendicular to the circular saw blade axis;

a log retainer tensioner end assembly with a first log centering pin and a log retainer indexer end assembly, with a second log centering pin clamped to the log retainer member and wherein the first log centering pin and the second log centering pins are coaxial with an indexing shaft axis and the space between the first log centering pin and the second log centering pin is adjustable;

a first two pairs of mating blocks mounted on the log holder frame and the trolley assembly that cooperate to hold the indexing shaft axis in a position parallel to the path of movement of the trolley assembly when the log holder frame assembly is pivoted about the second log holder axis to a first position; and a second two pairs of mating blocks mounted on the log holder frame and the trolley assembly that cooperate to hold the indexing shaft axis in a position parallel to the path of movement of the trolley assembly when the log holder frame assemble is pivoted about the second log holder axis to a second position.

2. A table saw mill attachment, as set forth in claim 1, wherein the at least one elongated guide bar includes a first elongated trolley guide rail and a second elongated trolley guide rail that is spaced from and parallel to the first elongated trolley guide rail, a pair of space apart first side wheels journaled on the trolley assembly and engaging the first elongated trolley guide rail, and a pair of spaced apart second side wheels journaled on the trolley assembly and engaging the second elongated trolley guide rail.

3. A table saw mill attachment, as set forth in claim 2, wherein each of the pair of space apart first side wheels include a groove that engages the first elongated trolley guide rail and guide the trolley assembly parallel to the first elongated trolley guide rail.

4. A table saw blade mill attachment, as set forth in claim 3, including an elongated center trolley guide rail that is between and parallel to the first elongated trolley guide rail and the second elongated trolley guide rail, and a trolley hold down car attached to the trolley assembly and including a hold down roller that engages the elongated center trolley guide rail and holds the pair of space apart first side wheels in engagement with the first elongated trolley guide rail and hold the pair of space apart second side wheels in engagement with the second elongated trolley guide rail.

5. A table saw mill attachment, as set forth in claim 2, including at least two spaced apart guide support bars that are both fixed to the first elongated trolley guide rail and the second elongated trolley guide rail and wherein the at least two spaced apart guide supports are engageable with a table saw fence to position the indexing shaft axis in selected positions relative to the circular saw blade.

6. A table saw attachment, as set forth in claim 1, wherein the at least one elongated log retainer member includes two space apart beams, the log retainer tensioner end assembly includes a tensioner shank that is received between the two space apart beams and is clamped to the two space apart beams in a selected position along the length of the two space apart beams, a threaded bore through the tensioner shank, a threaded tensioner rod received in the threaded bore and wherein the first log centering pin is pivotally supported on and coaxial with the threaded tensioner rod; and wherein the log retainer indexer end assembly includes an indexer shank received between the two space apart beams and clamped to the two spaced apart beams, an indexing shaft journaled in a passage through the indexer shank, an indexer block, with at least four indexing recesses, fixed to an end of the indexing shaft, an indexing lock selectively engageable with each of the at least four indexing recesses, and the second log centering pin secured to another end of the indexing shaft.

7. A table saw attachment, as set forth in claim 6, wherein the log retainer indexer end assembly is clamped to the spaced apart beams in selected positions along the length of the two spaced apart beams.

* * * * *